United States Patent [19]

Fischer

[11] Patent Number: 4,488,538

[45] Date of Patent: Dec. 18, 1984

[54] METHOD AND APPARATUS FOR MANUFACTURE OF A VESSEL

[76] Inventor: Karl Fischer, 7519 Oberderdingen, Am Gaensberg, Fed. Rep. of Germany

[21] Appl. No.: 343,369

[22] Filed: Jan. 27, 1982

Related U.S. Application Data

[63] Continuation-in-part of Ser. No. 102,692, Dec. 12, 1979, Pat. No. 4,320,644.

[30] Foreign Application Priority Data

Dec. 14, 1978 [DE] Fed. Rep. of Germany ..... 2853957

[51] Int. Cl.[3] ..... A47J 27/00

[52] U.S. Cl. ..... 126/390; 220/66; 220/70

[58] Field of Search ..... 220/66, 67, 70, 72; 72/68, 370; D7/358, 359, 354; 126/390

[56] References Cited

U.S. PATENT DOCUMENTS

| | | | |
|---|---|---|---|
| 1,454,836 | 5/1923 | Slocomb | 220/66 |
| 2,573,736 | 11/1951 | Scavullo | 72/82 |

FOREIGN PATENT DOCUMENTS

| | | | |
|---|---|---|---|
| 482485 | 6/1953 | Italy | 220/70 |
| 368522 | 3/1932 | United Kingdom | 72/68 |
| 393028 | 6/1933 | United Kingdom | 220/68 |

*Primary Examiner*—Lowell A. Larson

*Attorney, Agent, or Firm*—Steele, Gould & Fried

[57] ABSTRACT

A cooking vessel, comprising: a substantially cup-shaped stainless steel member forming a substantially cylindrical side wall and a substantially planar bottom, the lower portion of the side wall adjacent the bottom having an inwardly directed annular shoulder which is thicker than the remainder of the side wall, the bottom being thicker than the annular shoulder of the lower portion of the side wall, and the outer surface of the cylindrical wall being formed by a roller compression process which imparts thereto increased strength and toughness as well as a substantially crack-free and pore-free surface with a bright finish. The outer surface of a transition portion between the side wall and the bottom is flatly curved, the curved transition surface and the side wall meeting at a thin annular shoulder defined by a sharp edge at the bottom of the side wall. The lower surface of the bottom may be roughened to provide a non-skid surface with improved heat transfer characteristics.

4 Claims, 7 Drawing Figures

FIG. 3
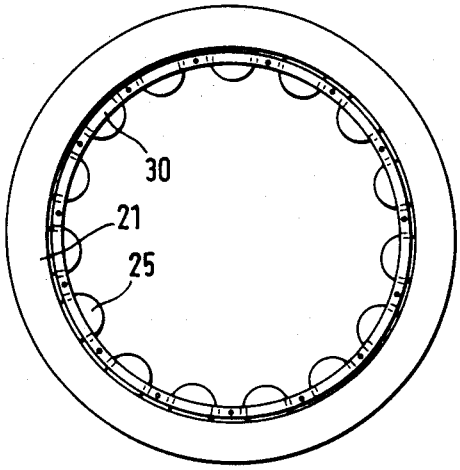
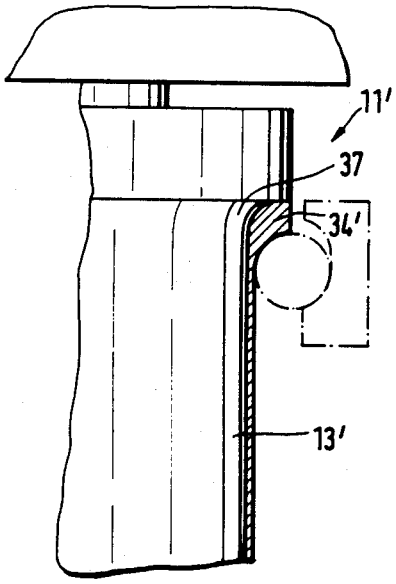
FIG. 6
FIG. 4
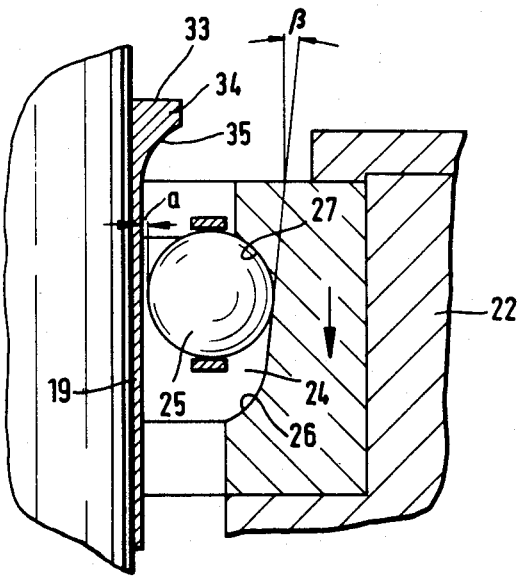
FIG. 5
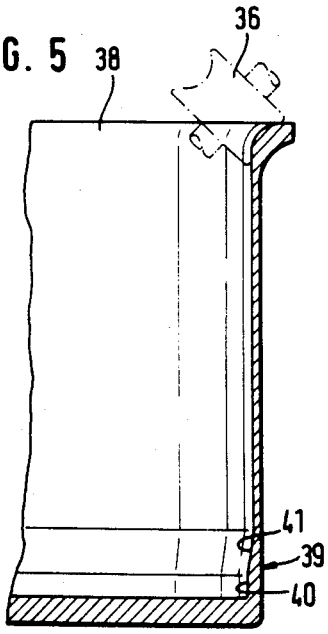

METHOD AND APPARATUS FOR MANUFACTURE OF A VESSEL

CROSS REFERENCE TO RELATED APPLICATION

This application is a continuation-in-part of copending application Ser. No. 102,692, filed Dec. 12, 1979, now U.S. Pat. No. 4,320,644.

BACKGROUND OF THE INVENTION

The present invention relates to a cooking vessel having improved structural and heat-transfer qualities, as well as to a method for producing such cooking vessels. In particular, such cooking vessels are one-piece, preferably being formed from stainless steel, cup-shaped blanks.

U.S. Pat. No. 3,556,032 describes a method permitting manufacture of a very thin-walled container with a curved bottom by a rolling process. For this purpose, an arrangement of four balls is used, the balls facing one another in pairs and being spring-mounted in the radial direction. The balls are located in spherical segments so that they are not peripherally rotated when the rolling process is started by rotating a central male die accompanied by the simultaneous axial movement of the rolling or curling tool. The bottom is also worked by a rolling tool provided around the edges between the bottom and the casing. The wall thickness is somewhat greater in this area than in the remainder of the casing. With this method and apparatus it is not possible to manufacture cooking vessels with a thick, and in particular, completely flat bottom from very hard materials, such as stainless steel.

Methods are also known for the manufacture of vessels, particularly cooking vessels, from softer materials such as aluminium, in which the casing is shaped by a rolling process using pressure rollers and its wall thickness is reduced (German Pat. No. 508,658, U.S. Pat. No. 2,160,975).

German Pat. No. 879,797, Offenlegungsschrift 2,452,374 and Swiss Pat. No. 297,494 disclose the deep drawing of such vessels. According to Offenlegungsschrift 1,652,630, the upper edge of the casing can be flanged by a rolling process.

None the above-described methods gives satisfactory results. In most methods, it is necessary to re-turn the bottom of the cooking vessel, because the latter is not sufficiently flat. Surface machining is also generally subsequently necessary, particularly in the case of deep drawn products, in order to remove machining marks. The flatness of the bottom (not to be confused with smoothness of surface texture) is of the greatest importance for a good heat transfer between the electrical hotplate and the cooking vessel and consequently for the efficiency of the cooking process.

SUMMARY OF THE INVENTION

The object of the invention is to provide an improved cooking vessel, made from one-piece blanks of hard material, as well as a method and an apparatus for manufacturing a cooking vessel with a flat bottom, with a minimum of subsequent machining.

According to the invention, this object is achieved in that a stainless steel vessel, serving as a cooking vessel with a flat bottom, may be shaped by a large number (more than 4) of balls which are rotatable, but are immovable in the radial direction.

According to the invention, the apparatus suitable for solving the problem has a mould part with substantially cylindrical mould faces and rolling or curling tools with balls associated therewith, the balls being rotatable relative to one another and axially movable, wherein the rolling tool comprises a rigid outer ring with a circulating groove in which are arranged a large number (more than 4) of balls which revolve and rotate about themselves.

The manufacture of the casing, which is substantially thinner than the blank and therefore the bottom, preferably takes place in a single operation without any intermediate heat treatment.

According to a particularly preferred embodiment of the method of the invention, the bottom of the vessel is made planar and smooth in that prior to the rolling-stretching of the casing the part of the material forming the casing and adjacent to the bottom part is radially inwardly deformed by means of the balls, preferably in a cavity formed between the mould part and the blank. Thus, there is a cavity between the blank and the mould part in the section adjacent to the bottom. If the rolling process starts from the bottom, the complete radial rolling pressure is not immediately exerted, which would otherwise subject the bottom to compression and consequently to an outward bulging. In fact, there is firstly a radially inwardly directed deformation into the cavity, followed by rolling-stretching with the full degree of stretching.

BRIEF DESCRIPTION OF THE DRAWINGS

For the purpose of illustrating the invention there are shown forms which are presently preferred; it being understood, however, that this invention is not limited to the precise arrangements and instrumentalities shown.

FIG. 3 is a plan view of the rolling tool;

FIG. 4 is a detail of the rolling tool during its return movement;

FIG. 5 is a part of the completely rolled vessel on re-working;

FIG. 6 is a detail of a variant of a rolling tool and the vessel rolled on it; and, FIG. 7 is a partial section view, in enlarged scale, of the transitional portion of the cooking vessel between the side wall and the bottom.

DETAILED DESCRIPTION OF THE PREFERRED EMBODIMENTS

Figure 1:
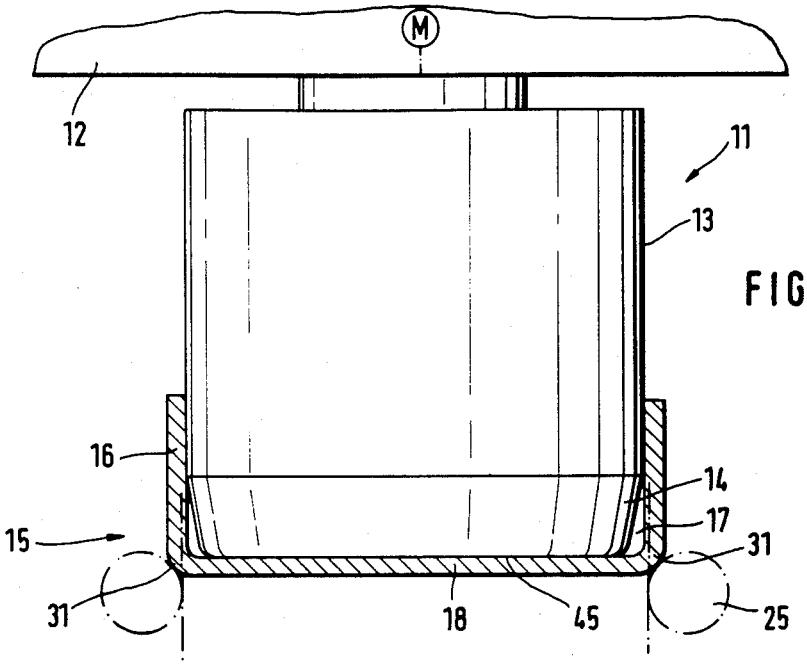
FIG. 1 is a partial sectional side view of a mould part and a blank for the manufacture of the vessel.

FIG. 1 shows a mould part 11 in the form of a substantially cylindrical male die or mandrel, which is driven in rotary manner by a moulding machine 12. The surface of mould part 11 forms a mould surface comprising a cylindrical portion 13 and a slightly conical portion 14 in the vicinity of the end face 13 of the mould part. For purposes of clarity, the size and conicity of the frustum-shaped portion 14 are shown in an exaggerated manner. Mould part or mandrel 11 is made from a very hard material and mould faces 13, 14 are burnished and optionally chromium plated.

A cup-shaped blank 15, made from a plate of stainless steel and which is preferably 2 to 4 mm thick, is placed on mould part 11. The internal diameter of the cylindrical casing 16 of the blank corresponds to the external diameter of the cylindrical mould face portion 13, which extends into the latter. Between the casing inner surface and the conical mould face portion 14, a cavity 17 is formed. The flat bottom 18 of the blank 15, made by a drawing or hobbing process from a plate, engages on the planar end face 45 of mould part 11. Casing 16 has approximately the same wall thickness as bottom 18.

Figure 2:
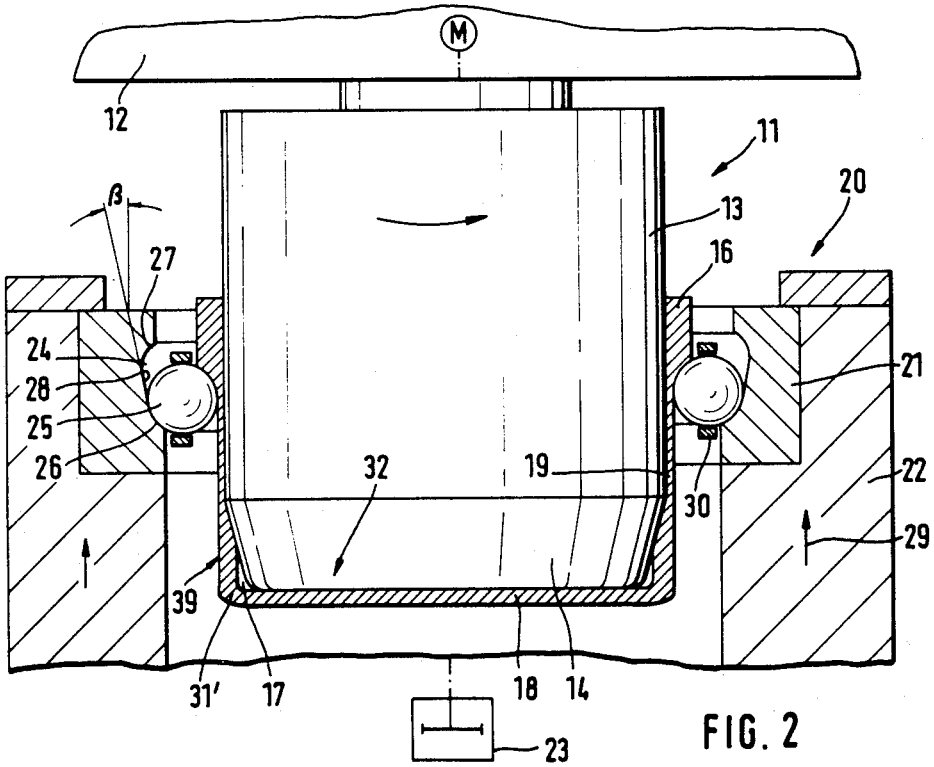
FIG. 2 is a view in accordance with FIG. 1 with the rolling tool during the rolling process.

FIG. 2 shows the rolling process which considerably reduces the wall thickness of casing 16 of the blank, so that a cooking vessel with a high, thin wall 19 is formed from the flat member. Rolling is carried out with a rolling tool 20, which is similar to a heavy ball bearing which, without an inner ring, is placed from the bottom side onto the blank located on mould part 11, accompanied by the rotation and simultaneous axial advance. It has an outer ring 21, which is mounted in a thrust ring 22 of moulding machine 12 and can be moved axially over the mould part and then back again by means of a feed mechanism 23, shown diagrammatically as a hydraulic cylinder, but which can also function mechanically. On its inside, outer ring 21 has a circulating groove 20, which is somewhat wider than would correspond to the balls 25 running in it. The lateral surfaces of the groove are formed by rounded shoulders 26, 27 whose radius of curvature corresponds to the balls. The connecting surface 28 between the rounded shoulders 26, 27 is, however, inclined in such a way (at an angle $\beta$), that the groove at rounded shoulder 26, which is at the rear in the feed direction 29, is narrower than at rounded shoulder 27.

As can be gathered from FIG. 3, a large number of balls 25 (e.g. 15) is provided, guided by a cage 30. Compared with a normal ball bearing, the groove 24 is particularly deep in the area of the rounded shoulder 26 which is loaded during the rolling process and, to the extent permitted by cage 30, extends into the central area of the balls. However, the boundary wall in the vicinity of rounded shoulder 27 need not be so deep. The slope of the connecting surface 28 is shown in exaggerated form for clarity. It is sufficient if the balls have some axial play in groove 24 and can be outwardly displaced by a few tenths of a millimeter. The transition can also be stepped.

The rolling process takes place in the following manner. If the rolling tool 20 is moved from below in FIG. 1 up to the blank rotating with the mould part 11, in the manner shown in broken line form, the balls 25 come into contact with edge 31 between casing 16 and bottom 18. The internal diameter between the balls in their position according to FIG. 2 (working position) is substantially smaller than the external diameter of the blank casing 16, but is thicker by the thickness of the vessel wall 19 than the cylindrical mould face portion 13. At the start of the rolling process, the casing material located in the vicinity of edge 31 is firstly substantially radially forced inwards into cavity 17, so that in this area the forces exerted by the rolling tool are significantly smaller than in the remainder of the rolling process. In particular, there is no significant compression or bulging of bottom 18, so that the latter remains flat. Surprisingly, the bending forces in the vicinity of edge 31 do not bring about any bulging of the bottom.

With increasing diameter of mould part 11, the material stretching produced by the rolling process is constantly increased and the material is forced upwards by the rolling tool. It is thereby worked or shaped, is given a great strength and toughness and a compressed, crack-free, pore-free and bright surface, which normally requires no further polishing. Accompanied by rotation, the balls revolve around themselves and the mould part in its rolling movement in the groove. Due to the large number of balls, which preferably have an uneven number, so that in each case one ball is supported on two facing balls in the form of a "three-point bearing", together with a relatively large circumferential speed of the mould part 11 which rotates with respect to the non-rotary outer ring 21 of the rolling tool, this surface finishing is obtained at the same time as the rolling-stretching process. It is also possible to rotate the rolling tool and/or to axially displace the mould part.

In FIG. 4, vessel 32 is completed, i.e. the casing surface of wall 19 is rolled out to its complete height. The rolling process is broken off somewhat below the upper vessel edge 33, so that at this point the complete thickness of the blank material is retained and is optionally even increased by a flange caused by the rolling tool, thereby forming an edge reinforcement 34 with a rolled channel 35.

FIG. 4 also shows that on moving back the rolling tool opposite to the feed direction 29, the balls are moved axially into the groove in such a way that their radial spacing with respect to one another is increased by the amount a and consequently a withdrawal of the rolling tool is possible without any increased contact between balls and casing surface 19. Since, following the rolling process, the surface is somewhat elastically expanded, which also facilities its removal from the mould part, a contact with the balls would otherwise be necessary and withdrawal would have to take place with further rolling.

On the inner edge of the upper rim, the finished vessel (FIG. 5) can be re-shaped by a rolling tool 36 or by metal cutting in order to create a pouring edge. According to the variant of FIG. 6, it is also possible to provide the mould part 11' with a downwardly directed fillet 37 which follows onto the cylindrical mould face 13' and which during the rolling process forms an inner roundness of the bead 34'. The rolling process is preferably stopped as a function of the bead force in order to avoid too high forces at the end of the rolling process when there are variations in the residual material in the bead 34' due to material tolerances.

In this case, the edge inner roundness 38, like the remaining inner surface of the casing wall 19, would have an excellent surface quality requiring no polishing and resulting from the highly polished mould faces 13, 14. The shape of the surface area 39 adjacent to the bottom formed with a conical construction of the mould face portion 14 is particularly apparent from FIGS. 2 and 5. Normally, the cavity 17 is not completely filled by material, so that over a radius to the bottom 18 a narrow cylindrical portion 40 and then a conical portion 41 are connected. The mould face portion 14 need not be conical and could also be curved or slightly stepped. It could also have the same shape as the vessel in area 39, but it is advantageous for a small part of the cavity 17 to be left over after the rolling process, because it is an expansion chamber which, as a function of the material tolerance and characteristics, ensures that no inadmissible compression forces are exerted on bottom 18 although balls 25 are guided in a rigid and not radially sprung outer ring and as a result the surface characteristics of the casing are uniform over the entire height.

Figure 7:
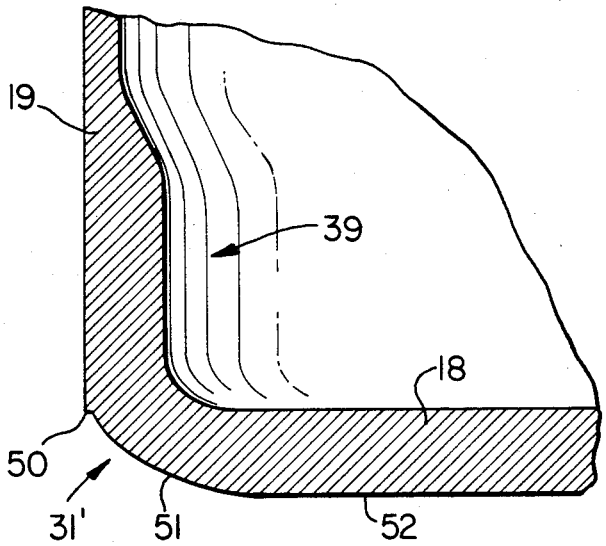

The shape of the transitional portion of the completed cooking vessel, formed from the one-piece blank 15, between the bottom and side wall is shown in greater detail in FIG. 7. The outer surface of the transitional portion is substantially a flatly curved surface 51 of relatively large diameter, which runs from the lower surface 52 of the bottom 18 to the lowermost edge 50 of the side wall 19. The lowermost edge of the side wall 50 is a sharp edge, forming a narrow annular shoulder 53. The sharp edge 50 of the side wall has the effect of visually extending the side wall downwardly, providing an enhanced ornamental effect. Despite this ornamental effect, and despite the existence of the sharp edge 50, which is formed automatically when rolling the outer surface of the wall 19, the flatly curved surface 51 facilitates pushing the cooking vessel on and off cooking plates, hotplates and kitchen tables, which will not be damaged even if downwardly projecting burrs are formed. In the inner portion of the transitional surface an inwardly projecting annual shoulder 54 is provided, which is thicker than the remainder of the side wall, and which is automatically formed during the rolling process. Despite this thickened portion of the side wall 19, the thickness of the bottom 18 is still greater than that of the side wall. The annular shoulder 54 provides increased structural integrity and enhances heat flow characteristics from the bottom of the vessel into the side wall.

A cooking vessel according to this invention may also be provided with a further advantageous feature. The lower surface 52 of the bottom 18 and the rounded portion 51 may be roughened or textured, for example by blasting these portions with corrundum. The resulting surface texture is somewhat finer than would be obtained in a normal sand-blasted surface. The resulting finish can be described in a variety of ways, such as matte, dull, satin or velvet-like. Although such a finished surface appears to be somewhat reflective, having a silver-like appearance, it has proved to have significantly better heat absorption characteristics than an unfinished surface, and even better heat absorption characteristics than a normal bottom surface produced by a turning operation. The precise reason for the better heat absorption characteristics is not known, however two features are believed to be of particular significance. The first is that the absence of a mirror-like surface reduces reflection of heat back downwardly away from the bottom of the cooking vessel. The other is that roughening, texturing or pitting the bottom surface actually increases the surface area which is exposed to the heat of the cooking plate. Moreover, it also appears that the bottom of the cooking vessel can be somewhat self-adapting with respect to the surface structure of the cooking plate on which it rests, as the roughened surface is a bit more prone to be abraded off. Finally, the resulting surface texture provides a beneficial non-skid characteristic.

The vessel used as a cooking vessel need subsequently only be provided with handles or grips and can otherwise be used without any further working of the bottom. The relatively thick bottom 18 brings about a good transfer of heat from a flat electric hotplate to the inside of the vessel as a result of its flatness and ensures a uniform heat distribution. Due to the one-piece construction without involving the assembly of parts, the flatness is retained, even in the case of varying heat conditions.

Typical dimensions are:

Thickness of bottom and portion 40: 2 to 3.5 mm

Height of portion 40: 2 mm

Height of area 39 (portions 40 & 41: 5 to 10 mm

Casing thickness: 0.5 to 0.8 mm

These dimensions can vary upwards or downwards, but preferably by no more than 20% as a function of the size and use of the cooking vessel. With its continuous cylindrical outer surface, the casing extends up to close to the edge 31' between bottom and casing surface 19 and passes with a bend into a gentle fillet to the bottom. The material is preferably chromium steel with a chromium content of 14% to 18% and preferably 16%. The thickness of casing wall 19 is between one third ($\frac{1}{3}$) and one sixth (1/6) of the bottom thickness.

This invention may be embodied in other specific forms without departing from the spirit or essential attributes thereof, and accordingly, reference should be made to the appended claims, rather than to the foregoing specification as indicating the scope of the invention.

I claim:

1. A cooking vessel, comprising:

a substantially cup-shaped stainless steel member forming a substantially cylindrical side wall and a substantially planar bottom, the side wall and bottom being integral parts of a single piece of metal;

a lower portion of the side wall adjacent the bottom having an inwardly directed annular shoulder which is thicker than the remainder of the side wall;

the bottom being thicker than any part of the side wall, the outer surface of the lower portion of the side wall terminating in an edge defining a thin, inwardly-directed annular shoulder; and, the cylindrical wall being roller-stretched in an axial direction, the wall having an outer surface formed by a roller compression process and having increased strength and toughness as well as a substantially crack-free surface with a bright finish.

2. The cooking vessel of claim 1, wherein the side wall and bottom meet at a transitional portion, the transitional portion having an annular, flatly curved outer surface.

3. The cooking vessel of claim 1, further comprising an outwardly projecting flange formed from the upper edge of the cylindrical side wall, the flange having a rounded transitional surface between the side wall and the outer edge of the flange.

4. The cooking vessel of claim 1, wherein the bottom further comprises a roughened, non-skid lower surface providing enhanced heat absorption characteristics.

* * * * *